US005208132A

United States Patent [19]

Kamada et al.

[11] Patent Number: 5,208,132

[45] Date of Patent: May 4, 1993

[54] PHOTOCHROMIC MATERIALS

[75] Inventors: Masayasu Kamada, Kusatsu; Shozo Suefuku, Otsu, both of Japan

[73] Assignee: Matsui Shikiso Chemical Co., Ltd., Kyoto, Japan

[21] Appl. No.: 828,951

[22] PCT Filed: Jun. 18, 1991

[86] PCT No.: PCT/JP91/00813

§ 371 Date: Feb. 10, 1992

§ 102(e) Date: Feb. 10, 1992

[30] Foreign Application Priority Data

Jun. 18, 1990 [JP] Japan ..... 2-160839

[51] Int. Cl.[5] ..... G03C 1/685; G03C 1/72

[52] U.S. Cl. ..... 430/138; 430/338; 430/339; 430/345; 428/402.2; 252/586

[58] Field of Search ..... 430/138, 338, 345, 339; 428/402.2; 252/586; 503/214, 215

[56] References Cited

U.S. PATENT DOCUMENTS

| | | | |
|---|---|---|---|
| 3,322,542 | 5/1967 | Ullman et al. | 430/338 |
| 4,720,356 | 1/1988 | Chu | 252/586 |
| 5,017,225 | 5/1991 | Nakanishi et al. | 428/402.2 |

OTHER PUBLICATIONS

Japanese Unexamined Patent Publication (kokai) No. 27586/1988; Feb. 1988.

Japanese Unexamined Patent Publication (kokai) No. 110173/1990; Apr. 1990.

*Primary Examiner*—Marion E. McCamish

*Assistant Examiner*—Christopher D. RoDee

*Attorney, Agent, or Firm*—Larson and Taylor

[57] ABSTRACT

The photochromic material of the invention is such that a composition having an organic photochromic compound dissolved or dispersed in a hindered amine-type compound is microencapsulated. The photochromic material of the invention is not deteriorated in photochromic properties and can be used for a wide range of applications even when coloring or decolorizing repeatedly occurs on intermittent irradiation in air or when it is continuously irradiated with light for a long term.

5 Claims, No Drawings

PHOTOCHROMIC MATERIALS

FIELD OF THE INVENTION

The present invention relates to a photochromic material.

BACKGROUND ART

Silver halide is an inorganic photochromic material known from old times as a material causing the so-called photochromic phenomenon according to which a color reversibly changes depending on the presence or the absence of light. Although capable of exhibiting a high sensitivity to coloring and to decolorizing and a high resistance to light, silver halide induces only a narrow range of color change in respect of limited kinds of hue and is difficult to use in combination with other materials than inorganic glass. With these drawbacks, silver halide has been used for extremely limited applications, for example, as lenses for spectacles, automotive sunroof materials, etc.

In recent years, there have been developed numerous photochromic materials comprising organic photochromic compounds which induce a broad range of color change in respect of extended kinds of hue and which are highly compatible with synthetic resins and with various organic compounds. These organic photochromic materials are expected to find a wide range of applications. Known as such organic photochromic compounds are azobenzene-type compounds, thioindigo-type compounds, dithizone metal complexes, spiropyran-type compounds, spirooxazine-type compounds, fulgide-type compounds, dihydropyrene compounds, spirothiopyran-type compounds, 1,4-2H-oxazine, triphenylmethane-type compounds, viologen-type compounds, pyran-type compounds, etc. Of these compounds, spiropyran-type compounds, spirooxazine-type compounds and pyran-type compounds are excellent in the sensitivity to coloring and in the color density. Strenuous efforts have been made to alleviate the conventional problems that these compounds involve a low rate of color reversion and reduce the color density or decolorize at a temperature higher than room temperature. As a result, the compounds substantially free of these shortcomings have been prepared. However, these organic photochromic compounds are so low in the stability to light that the compounds may decompose in a few days and become non-responsive to light, when coloring or decolorizing repeatedly occurs on intermittent irradiation or are subjected to continuous irradiation in air.

To obviate this serious drawback, various attempts have been made by incorporating additives into the organic photochromic compound with the effects already disclosed. Heretofore disclosed as such additives are hindered phenol-type, phosphite-type and thioether-type antioxidants, ultraviolet absorbers, singlet oxygen quenchers, nickel-type metal complexes and hindered amine-type compounds. Yet the use of additives other than hindered amine-type compounds produce substantially no effect. When used to enhance the light resistance of organic photochromic material, a hindered amine-type compound has been added to a high-molecular-weight synthetic resin matrix along with the organic photochromic material to provide a resin matrix. In this case, the hindered amine-type compound is used in the form as incorporated in the resin matrix or in a coating composition or a printing ink containing the resin matrix dissolved or dispersed in a suitable organic solvent. The organic photochromic material containing the hindered amine-type compound in this form remains insufficient in the resistance to light although higher in this property than when free of a hindered amine-type compound, and is low in the sensitivity to coloring and in the rate of color reversion and poor in the color density because the organic photochromic compound is present as dispersed in the resin. While an attempt was made to lessen the drawbacks by use of a plasticizer, the use of plasticizer reduces the resistance to light, resulting in failure to achieve the contemplated object. Since the hindered amine-type compound used in the above manner exists in the mixture containing the resin, and is less compatible with the resin, the excess compound would be separated out if an increased amount thereof is used. For this reason, the hindered amine-type compound has been used in an amount equal to or less than that of the organic photochromic material.

DISCLOSURE OF THE INVENTION

In view of the above state of the art, the present invention has been accomplished to provide a photochromic material which will not be deteriorated the photochromic properties (exhibits a high resistance to light) even when coloring or decolorizing repeatedly occurs on intermittent irradiation in air or when continuously exposed to light for a long term, and which is usable for a wide range of applications.

According to the present invention, there is provided a photochromic material which is characterized in that a composition having an organic photochromic compound dissolved or dispersed in a hindered amine-type compound is microencapsulated.

The present inventors' research revealed the following. When an organic photochromic compound is dissolved or uniformly dispersed in a hindered amine-type compound used as a medium, the resulting composition is excellent in the photochromic properties and has the organic photochromic compound remarkably improved in the resistance to light. When a hindered amine-type compound is used in an amount of at least 5 times the weight of the organic photochromic compound, the above result is more remarkable. The composition is finely divided and the resulting particles are coated with a high-molecular-weight compound to achieve microencapsulation, whereby the system containing the organic photochromic compound and the hindered amine-type compound is made present independently of the resin, plasticizer, surfactant, solvent and the like which are conjointly used according to a particular use with the result that the organic photochromic compound is imparted an improved resistance to light and can retain the sensitivity to coloring, color reversion and color density and other properties.

Examples of organic photochromic compounds useful in the invention are conventional compounds such as spirooxazine-type compounds, spiropyran-type compounds and pyran-type compounds, etc. Examples of spirooxazine-type compounds include 1,3,3-trimethylspiro[indoline-2,3'-(3H)naphtho(2,1-b)(1,4)-oxazine] (hereinafter referred to as "Compound 1"), 5-chloro-1,3,3-trimethylspiro[indoline-2,3'-(3H)naphtho(2,1-b)(1,4)-oxazine] (hereinafter referred to as "Compound 2") and 1,3,3,5-tetramethylspiro[indoline-2,3'-(3H)naphtho(2,1-b)(1,4)-oxazine] (hereinafter referred to as "Compound 3") as disclosed in Japanese Examined Patent Publication SHO 45-28892; 1,3,3-trimethyl-9'-methoxyspiro[indoline-2,3'-(3H)naphtho(2,1-b)(1,4)-oxazine] (hereinafter referred to as "Compound 4"), 1,3,3,5-tetramethyl-9'-methoxyspiro[indoline-2,3'-(3H)naphtho(2,1-b)(1,4)-oxazine] (hereinafter referred to as "Compound 5") and 1,3,3,5,6-pentamethyl-9'-methoxyspiro[indoline-2,3'-(3H)naphtho(2,1-b)(1,4)-oxazine] (hereinafter referred to as "Compound 6") as disclosed in Japanese Unexamined Patent Publication SHO 55-36284; 4-trifluoromethyl-1,3,3-trimethyl-5'-methoxyspiro[indoline-2,3'-(3H)naphtho(2,1-b) (1,4)-oxazine] (hereinafter referred to as "Compound 7"), 6'-trifluoromethyl-1,3,3,-trimethyl-5'-methoxyspiro[indoline-2,3'-(3H)naphtho(2,1-b)(1,4)-oxazine] (hereinafter referred to as "Compound 8") and 4-trifluoromethyl-1,3,3-trimethyl-9'-methoxyspiro[indoline-2,3'-(3H)naphtho(2,1-b) (1,4)-oxazine] (hereinafter referred to as "Compound 9") as disclosed in Japanese Unexamined Patent Publication SHO 60-53586; 1,3,5,6-tetramethyl-3-ethylspiro[indoline-2,3'-(3H)pyrido(3,2-f)(1,4)-benzooxazine] (hereinafter referred to as "Compound 10"), 1,3,3,5,6-pentamethylspiro[indoline-2,3'-(3H)pyrido(3,2-f)(1,4)-benzooxazine] (hereinafter referred to as "Compound 11") and 1-methyl-3,3-diphenylspiro[indoline-2,3'-(3H)pyrido(3,2-f)(1,4-benzooxazine] (hereinafter referred to as "Compound 12") as disclosed in Japanese Unexamined Patent Publications SHO 60-112880 and 61-159458; 1-benzyl-3,3-dimethylspiro[indoline-2,3'-(3H)naphtho(2,1-b)(1,4)-oxazine] (hereinafter referred to as "Compound 13"), 1-(4-methoxybenzyl)-3,3-dimethylspiro[indoline-2,3'-(3H)naphtho(2,1-b)(1,4)-oxazine] (hereinafter referred to as "Compound 14"), 1-(3,5-dimethylbenzyl)-3,3-dimethylspiro[indoline-2,3'-(3H)naphtho(2,1-b)(1,4)-oxazine] (hereinafter referred to as "Compound 15"), 1-(4-chlorobenzyl)-3,3-dimethylspiro[indoline-2,3'-(3H)naphtho(2,1-b)(1,4)-oxazine] (hereinafter referred to as "Compound 16") and 1-(2-fluorobenzyl)-3,3-dimethylspiro[indoline-2,3'-(3H)naphtho(2,1-b)(1,4)-oxazine] (hereinafter referred to as "Compound 17") as disclosed in Japanese Unexamined Patent Publication SHO 61-233079; 6'-piperidine-1,3,3-trimethylspiro[indoline-2,3'-(3H)naphtho(2,1-b)(1,4)-oxazine] (hereinafter referred to as "Compound 18"), 6'-indoline-1,3,3-trimethylspiro[indoline-2,3'-(3H)naphtho(2,1-b)(1,4)-oxazine] (hereinafter referred to as "Compound 19"), and a compound represented by the formula

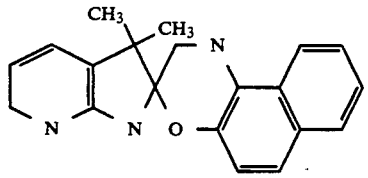

(hereinafter referred to as "Compound 20") as disclosed in Japanese Unexamined Patent Publication SHO 64-33154. Examples of spiropyran-type compounds are 1-(2,3,4,5-pentamethylbenzyl)-3,3-dimethylspiro[indoline-2,3'-(3H)naphtho(2,1-b)-pyran] (hereinafter referred to as "Compound 21") and 1-(2-methoxy-5-nitrobenzyl)-3,3-dimethylspiro[indoline-2,3'-(3H)naphtho(2,1-b)-pyran] (hereinafter referred to as "Compound 22") as disclosed in Japanese Unexamined Patent Publication SHO 62-153288. Examples of pyran-type compounds include 2,2-di-p-methoxyphenylnaphtho (2,1-b)pyran (hereinafter referred to as "Compound 23"), 2,2-di-p-methoxyphenylphenanthra (2,1-b)pyran (hereinafter referred to as "Compound 24"), 2,2-diphenylnaphtho (2,1-b)pyran (hereinafter referred to as "Compound 25") and 2,2-diphenylphenanthra (2,1-b)pyran (hereinafter referred to as "Compound 26") as disclosed in Japanese Unexamined Patent Publication SHO 64-33154.

Hindered amine-type compounds useful in the present invention are various and include known hindered amine-type compounds. Examples of useful hindered amine-type compounds include bis(2,2,6,6-tetramethyl-4-piperidinyl)sebacate (trade name "Sanol LS 770", product of Sankyo Co., Ltd.) (hereinafter referred to as "Compound a"), bis(1,2,2,6,6-pentamethyl-4-piperidinyl)sebacate (trade name "Sanol LS 765", product of Sankyo Co., Ltd.) (hereinafter referred to as "Compound b"), poly[{6-(1,1,3,3-tetramethylbutyl-)amino-1,3,5-triazine-2,4-diyl}{(2,2,6,6-tetramethyl-4-piperidinyl)imino}hexamethylene 2,2,6,6-tetramethyl-4-piperidinyl)imino] (hereinafter referred to as "Compound c") , 1-(2-hydroxyethyl)-4-hydroxy-2,2,6,6-tetramethylpiperidine polycondensation product (hereinafter referred to as "Compound d"), 2-(3,5-di-t-butyl-4-hydroxybenzyl)-2-n-butylmalonic acid bis(1,2,2,6,6-pentamethyl-4-piperidyl) (trade name "Tinuvin 144", product of Ciba Geigy Corp.) (hereinafter referred to as "Compound e"), 1-[2-{3-(3,5-di-t-butyl-4-hydroxyphenyl)propionyloxy}-ethyl]-4-{3-(3,5-di-t-butyl-4-hydroxyphenyl)propionyloxy}-2,2,6,6-tetramethylpiperidine} (trade name "Sanol LS-2626, product of Sankyo Co. Ltd.) (hereinafter referred to as "Compound f"), 8'-benzyl-7,7,9,9-tetramethyl-3-octyl-1,3,8-triazaspiro[4,5]undecane-2,4-dione (trade name "Sanol LS-1114, product of Sankyo Co., Ltd.) (hereinafter referred to as "Compound g"), Mark LA 57 (product of Adeka Argus Co., Ltd.) (hereinafter referred to as "Compound h"), Mark LA 62 (product of Adeka Argus Co., Ltd.) (hereinafter referred to as "Compound i"), Mark LA 67 (product of Adeka Argus Co., Ltd.) (hereinafter referred to as "Compound j"), Mark LA 63 (product of Adeka Argus Co., Ltd.), Mark LA 68 (product of Adeka Argus Co., Ltd.) and Tinuvin 622 LD (product of Ciba Geigy Corp.).

The proportions of the organic photochromic compound and the hindered amine-type compound used in the invention are at least about 5 parts by weight, preferably about 10 to about 50 parts by weight, of the latter per part by weight of the former.

The photochromic material of the invention can be prepared, for example, as follows. The organic photochromic compound is dissolved in the hindered amine-type compound on heating to give an oily product. The oily product and a film-forming substance are mixed with water or an organic solvent which optionally contains a surfactant, a protective colloid, a pH adjustor, an electrolyte and the like. The mixture is stirred to accomplish emulsification, producing oil droplets. The stirring rate is adjusted to give oil droplets of about 1 to about 50 μm, preferably about 3 to about 15 μm in particle size. The oil droplets are then microencapsulated by conventional encapsulation methods such as interfacial polymerization, in-situ polymerization, coacervation and so forth, whereby the photochromic material of the invention is produced.

Examples of film-forming substances useful to coat the oil droplets therewith are polyurea, polyamide, polyester, polyurethane, epoxy resin, urea resin, melamine resin, gelatin, ethyl cellulose, polystyrene, polyvinyl acetate and like high-molecular-weight compounds. The amount of the film-forming substance used in microencapsulation is in a conventional range and is selected from a wide range. For example the amount of the substance used is about 0.1 to about 1 times the combined weight of the organic photochromic compound and the hindered amine-type compound enclosed in the microcapsules.

The surfactant, protective colloid, pH adjustor, electrolyte, organic solvent and the like are preferably those conventionally used in the encapsulation methods.

The surface of the photochromic material obtained above may be crosslinked with a melamine resin, urea resin, epoxy resin, aldehyde-type compound isocyanate-type compound or the like. The crosslinkage strengthens the microcapsule wall and enhances the resistance to heat.

The photochromic material in a preferred form is prepared by applying a hydrophilic high-molecular-weight compound to the above-obtained photochromic material microencapsulated with the thermosetting film wall. Examples of useful hydrophilic high-molecular-weight compounds are gum arabic, gelatin, polyvinyl pyrrolidone, polyvinyl alcohol, carboxymethyl cellulose, methyl cellulose, ethyl cellulose, sodium polyacrylate, polyacrylamide, styrene-maleic anhydride copolymer, ethylene-maleic anhydride copolymer, etc. The coating can be applied by conventional methods as by in-situ method, coacervation method, air-suspension method, interface sedimentation method, etc. The photochromic material thus obtained is in the form of particles coated with a non-thermoplastic, seamless film wall so that the organic photochromic compound and the hindered amine-type compound is present in the photochromic material as completely shielded from outside and protected with improved resistance to heat and to friction pressure.

According to the invention, additives conventionally used in the art may be optionally included in microcapsules together with the organic photochromic compound and hindered amine-type compound. Examples of useful additives are plasticizers, solvents, antioxidants, infrared radiation absorbers, singlet oxygen quenchers, fats and oils, waxes, synthetic resins, etc. The proportions of the additives are up to about 30% based on the total weight of the organic photochromic compound and the hindered amine-type compound. When the additives are used in the above quantity range, the color density can be improved and the color can be changed without causing the photochromic material to reduce the resistance to light.

The photochromic material of the invention thus prepared is uniformly dispersed in an ink vehicle or a paint vehicle to obtain a photochromic ink or a photochromic paint. The obtained ink or paint is applied to the surface of a substrate to form thereon photochromic patterns, letters or figures, photochromic films or the like. The coating is applied by printing methods such as gravure printing, offset printing, screen printing or tampo printing methods or by coating methods such as brushing, die coating, dipping, roll coating, knife coating, shower coating or spray coating. Examples of useful substrates are papers, mono- or multi-filament fibers, fiber-knitted fabrics, non-woven fabrics, synthetic resin films, synthetic resin moldings, articles of glass, pottery, leathers, metals, wood or other materials, and so on. The photochromic material of the invention can be made into writing inks by being uniformly dispersed in a vehicle for writing inks. Also photochromic molded products can be produced by molding the photochromic material of the invention homogeneously dispersed in a natural, semi-synthetic or synthetic resin, or wax.

The photochromic material of the invention can be used for various applications. Specific examples of applications are described below in more detail.

High pile knits produced by implanting in a reticular substrate a thread of mono- or multi-filaments coated by dipping with a photochromic coating composition, the rear side of the substrate being backed with an adhesive agent, and articles and goods produced from such knits including stuffed toys, doll hairs, wigs, carpets, clothings, interior goods, footwears, miscellaneous goods, etc.

Strips of cloth coated with a photochromic coating composition, and articles and goods produced from the coated strip of cloth, such as clothings, interior goods, footwears, miscellaneous goods, etc.

Articles made of glass, pottery, plastics, metals or the like printed with a photochromic ink by screen printing or gravure printing, such as containers for foods, drinking water or cosmetics, including glass cups, glass bottles, glass materials, steins, mugs, teacups, plastics cups, plastics bottles and the like, brooches, emblems and like ornaments, pencil cases, erasers and like stationery products, name cards, cards, bags, toys, etc.

Mono- or multi-filaments coated with a photochromic coating composition, and articles produced from them such as doll hairs, wigs artificial animal hairs embroidery threads, and knitted fabrics including clothings, interior goods, footwears, miscellaneous goods, etc.

Articles produced by coating papers, plastics films or the like with a photochromic coating composition or by printing them with a photochromic ink, such as fancy papers, artificial flowers, paper cups, name cards, books, picture books, wall papers, wrapping papers, etc.

Articles printed with a photochromic printing ink including clothings such as jumpers, coats, jackets, sweaters, blouses, T shirts, trousers, skirts, one-piece dresses, stockings, gloves, headgears, handkerchiefs, towels, ties, ski wears, swimsuits, sports wears, ribbons, mufflers, neckerchiefs and the like, footwears such as slippers, sandals, shoes, boots and the like, interior goods such as curtains, carpets, cushions, shop curtains, pennants, table cloths, mats, artificial flowers, coasters and the like, bags, handbags, miscellaneous goods, toys, stationery, sports goods, etc.

Articles printed with a photochromic tampo ink, such as those of plastics metals glass or pottery, including dolls, animal toys, automobile toys and like toys, containers for foods, beverage, cosmetics or the like, brooches, emblems and like ornaments, stationery, name cards, cards, miscellaneous goods, etc.

Writing implements such as ball-point pens, felt-tipped markers, colors and the like filled with or containing a photochromic writing ink.

Flocked strips of cloth produced by coating a strip of cloth or a two-layer laminate of cloth and sponge with a photochromic coating composition and flocking the coating with short fibers, and articles produced therefrom including stuffed dolls, carpets, clothings, interior goods, footwears, miscellaneous goods, etc.

Articles of ABS, polyurethane foam, polyvinyl chloride or other plastics, metals, glass or pottery coated with a photochromic coating composition, such as automobile toys, animal toys, dolls, sets of toys for playing house, toy foods, containers for foods, drinking water, cosmetics or the like, moldings of shape memory metals or shape memory resins, prepaid cards, etc.

Thermal-type transfer sheets produced by printing designs, letters, figures, marks or the like on a releasable substrate with a photochromic ink and coating the printed surface with an adhesive agent, and articles of fibers, leathers, plastics (vinyl chloride or the like) or the like with designs, letters or the like transferred thereto from the sheet, such as clothings, interior goods, footwears, miscellaneous goods, toys, stationery, sports goods, etc.

Water-type transfer sheets produced by coating a releasable substrate with an adhesive agent, printing designs, letters, figures, marks or the like on the coated substrate with a photochromic ink and forming a covering layer over the printed surface, and articles of plastics, glass, pottery or metals with designs, letters or the like transferred thereto from the sheet, such as containers for foods, beverage, cosmetics or the like, e.g. glass cups, glass bottles, wine glass, steins, mugs, plastics cups or plastics bottles, miscellaneous goods, toys, stationery, etc.

Flocked transfer sheets produced by flocking fibers on a releasable substrate, coating the same with a photochromic ink and forming designs, letters, figures, marks or the like on the coated substrate with an adhesive agent, and articles of fibers, leathers, plastics or other materials with designs or the like transferred thereto from the sheet, such as clothings, footwears, interior goods, miscellaneous goods, toys, stationery, etc.

Tacky seals produced by forming designs, letters, figures, marks or the like on the front surface of a substrate with a photochromic ink, superposing a transparent film on the inked surface with an adhesive agent and adhering a releasable sheet to the rear side of the substrate with an adhesive agent, and articles with the seal attached thereto, e.g. clothings, miscellaneous goods, toys, stationery, etc.

Materials with a photochromic material uniformly dispersed therein, such as wheat flour clay, plastics clay, shape memory resins, candles, crayons, etc.

Color masterbatches prepared by uniformly dispersing a photochromic material in plastics such as polyethylene, polypropylene, polystyrene, nylon, polyester, polycarbonate, butadiene-styrene copolymer, acrylonitrile-styrene copolymer or the like, color masterbatches prepared by uniformly dispersing a photochromic material and wax in the above plastics, and concsols prepared by uniformly dispersing a photochromic material in a vinyl chloride plastisol, and articles produced by adding molding plastics, vinyl chloride plastisol or shape memory resin to one of color masterbatches and concsol and molding the mixture by injection molding, vacuum molding, compression molding, foam molding, blow molding, extrusion molding, slush molding, calender molding, etc., examples of these articles being toys such as dolls, animal toys, fish toys, automobile toys, food toys, sets of toys for playing house, plastics cups, plastics bottles artificial straws and like containers for foods, drinking water or cosmetics, artificial flowers, brooches, pendants and like ornaments, packaging films, shrink films, miscellaneous goods, stationery, etc., filaments produced by spinning one of masterbatches and concsol in a fused state or by spinning the same through extrusion, articles produced from the filaments, such as doll hairs, wigs, artificial animal hairs, stuffed dolls, carpets, curtains and so on, and articles produced by knitting the filaments, such as clothings, interior goods, footwears, miscellaneous goods, etc.

Highly moisture-permeable printed photochromic strips of cloth produced by printing designs or the like with a photochromic ink on part of one side of a substrate made of transparent synthetic fiber threads, and applying to the printed surface a coating composition containing a polyurethane resin to form a porous film, and articles produced from the fabrics, such as clothings, interior goods, miscellaneous goods, etc.

The foregoing inks, coating compositions, plastics or the like may contain additional chemical compounds such as surfactants, drying modifiers, anti-foaming agents, crosslinking agents, catalysts, viscosity modifiers, dyes, pigments, fluorescent pigments, fluorescent dyes, extender pigments, thermochromic materials, luminous pigments, metal powders antiseptic agents, antistatic agents, foaming agents, flame retardants, ultraviolet absorbers, ultraviolet stabilizers, antioxidants, plastics stabilizers, lubricants, perfume, age resistors, etc. which are suitably selected according to a particular use.

The photochromic material of the invention can be used for other applications in which a dye or a pigment is usually employed.

The photochromic material of the invention is excellent in the resistance to light and can be used for a wide range of applications.

The photochromic material of the invention is excellent in the color density, sensitivity to coloring, rate of color reversion, resistance to heat, resistance to friction pressure and like properties, and causes color change over a wide range in respect of various hues.

Given below are Examples to clarify the features of the invention.

EXAMPLE 1

A homogeneous hot solution of 10 parts (parts by weight, the words part or parts used herein are all by weight) of Compound 1, 150 parts of Compound a and 30 parts of an epoxy resin ("Epikote 828", product of Yuka Shell Epoxy K.K.) was poured into 500 parts of a 5% aqueous solution of hydroxyethyl cellulose heated to 60° C. The mixture was dispersed with stirring to form oil droplets of about 10 μm in diameter. Subsequently, 12 parts of a curing agent ("Epicure U", product of Yuka Shell Epoxy Co., Ltd.) for curing epoxy resins was added and the mixture was heated with stirring to a temperature of 90° C. over a period of 2 hours for reaction. The mixture was cooled and the microencapsulated particles obtained were separated by filtration, washed with water and dried, giving about 200 parts of a photochromic material. A 100 parts quantity of the photochromic material obtained above was added to 500 parts of a 5% aqueous solution of gelatin heated to 60° C., and the mixture was stirred and dispersed homogeneously. To the dispersion obtained was added with stirring 50 parts of a 5% aqueous solution of carboxymethyl cellulose. The mixture obtained was adjusted to a pH of 5.5 and was cooled to 10° C. A 25 parts quantity of a 10% aqueous solution of formalin was added and the mixture was allowed to stand for 5 minutes. While adding a 10% aqueous solution of caustic soda, the pH of the reaction system was adjusted to 10. The obtained dispersion of microcapsules 12 to 15 μm in diameter was separated by filtration, washed with water and air-dried, followed by drying at 80° C. for 2 hours, giving about 120 parts of a photochromic material. This material will be hereinafter referred to as "photochromic material 1".

EXAMPLES 2 TO 19

The same procedure as in Example 1 was repeated with the exception of using Compound 4, Compound 7 or each of Compounds 10 to 25 in place of Compound 1, giving photochromic materials. These materials will be hereinafter called "photochromic materials 2 to 19".

EXAMPLES 20 TO 26

The same procedure as in Example 1 was repeated with the exception of using Compound b, Compound e, Compound f, Compound g, Compound h, Compound i or Compound j in place of Compound a, giving photochromic materials. These materials will be hereinafter referred to as "photochromic materials 20 to 26".

EXAMPLE 27

A 50 parts quantity of a polyvalent isocyanate ("Millionate MR", product of Nippon Polyurethane Industry Co., Ltd.) was added to 10 parts of Compound 10 and 190 parts of Compound j. The mixture was heated with stirring to form a homogeneous dispersion. The homogeneous dispersion was suspended and dispersed in 2000 parts of an aqueous solution of a dispersion stabilizer heated to 60° C. which stabilizer contained 10 parts of colloidal tribasic calcium phosphate and 0.2 part of sodium dodecylbenzene-sulfonate with stirring by a stirrer so controlled in rate as to adjust the mean size of particles in the homogeneous dispersion to 5 μm. To the dispersion was added dropwise 10 parts of xylylene diamine and the dispersion was stirred at 60° C. for about 3 hours to complete the reaction. Thereafter, the dispersion stabilizer was decomposed and removed using a hydrochloric acid, followed by filtration, washing with water and drying, giving about 260 parts of a photochromic material. A 100 parts quantity of the obtained photochromic material was poured with stirring into 1000 parts of an aqueous solution containing 5 parts of an anionic surface active agent ("Demol N", product of Kao Co., Ltd.) to form a dispersion. To the dispersion was added dropwise 20 parts of melamine.-formalin prepolymer, and the mixture was heated to 80° C. Next, 1.0N-hydrochloric acid was added dropwise to adjust the pH of the system to 4.5. The mixture obtained was stirred at the same temperature for 2 hours, then cooled, filtered, washed with water and dried to produce about 120 parts of a photochromic material. This material will be hereinafter called "photochromic material 27".

EXAMPLE 28

With use of a screen (80 mesh) on which a floral pattern was formed, an ink for textile printing which consisted of 20 parts of the photochromic material 1 and 80 parts of an acrylic ester-based resin emulsion (binder for textile printing, trade name: "Binder 350R", product of Matsui Shikiso Chemical Co., Ltd.) was printed on cotton broad cloth to a film thickness of about 30 μm on dry basis. The printed cloth was dried and heat-treated at 140° C. for 5 minutes. This cloth was cut and sewed to produce a printed T-shirt. This T-shirt was plain and white within a room in which the sunlight did not stream. However, a blue floral design appeared on the T-shirt at the window or outside the room where the T-shirt was exposed to the sunlight. When the T-shirt was brought back into the room in which sunlight did not stream, the T-shirt became plain and white. The light resistance of this ink was sixth grade (according to "Weatherability, color fastness to light and colors" by Nagaichi Suga (Suga Test Instruments Co., Ltd., 1988); this property will be rated according to the same criteria hereinafter).

COMPARATIVE EXAMPLE 1

To 0.8 part of Compound 1 were added 0.4 part of Compound a and 10 parts of xylene, and the mixture was heated for dissolution. This solution was added with stirring to 100 parts of an acrylic ester-based resin emulsion ("Binder 350R") and homogeneously dispersed to prepare an ink for textile printing. Using this ink, a printed T-shirt on which a floral design was drawn was produced in the same manner as in Example 28. The printed portion of the T-shirt became colored and colorless repeatedly in the presence or absence of sunlight as is the case with Example 28. However, the light resistance of the ink was first or second grade.

COMPARISON EXAMPLES 2 AND 3 AND EXAMPLES 29 TO 31

Using Compound 1 and Compound a in the ratios as listed below in Table 1 photochromic materials were prepared in the same manner as in Example 1. In Comparison Examples 2 and 3, Compound 1 failed to be homogeneously dispersed in Compound a. In view of difficulty in producing microcapsules in this state, 12 parts and 8 parts of xylene were each added to the compounds in Comparison Examples 2 and 3, respectively (xylene was completely evaporated in the step of producing microcapsules). In each case, the amount of the film-forming component was adjusted to 50% of the total weight of Compound 1 and Compound a. Using these photochromic materials, floral design-printed T-shirts were produced in the same manner as in Example 28.

Table 1 also shows the measurements of light resistance and color density. The color density of floral designs was evaluated based on the initial color density (taken as 100) of the floral design obtained in Example 29.

TABLE 1

| | Comp. Example | | Example | | |
|---|---|---|---|---|---|
| | 2 | 3 | 29 | 30 | 31 |
| Compound 1 (part) | 1 | 1 | 1 | 1 | 1 |
| Compound a (part) | 0.5 | 4 | 5 | 10 | 50 |
| Color density | 250 | 110 | 100 | 55 | 12 |
| Light resistance (grade) | 2 | 3 | 5 | 6 | 7 |

Table 1 reveals that use of Compound a in an amount of less than 5 parts per part of Compound 1 leads to a poor light resistance and a low rate of coloring or decolorizing, hence unsuited to use. In this case, the actual color density is extremely lower than expected from the content of Compound 1. Accordingly when the light resistance and the color density are considered collectively, preferred results can be obtained by using Compound a in an amount of about 10 to about 50 parts.

COMPARISON EXAMPLE 4

A 10 parts quantity of Compound 1, 5 parts of Compound a and 500 parts of a 30% polystyrene resin (xylene solution) were heated for dissolution. In the same manner as in Example 1, the obtained mixture was made into microcapsules to obtain a photochromic material (xylene was completely evaporated in the step of production of microcapsules). Using the microcapsules, a floral design-printed T-shirt was produced in the same manner as in Example 28. The results were substantially the same as those obtained in Comparison Example 1.

TEST EXAMPLE 1

An ink comprising 3 parts of the photochromic material 1, 2 parts of a thermochromic particulate substance (trade name: "Chromicolor M-27 Magenta", product of Matsui Shikiso Chemical Co., Ltd.), 1 part of a water-dispersed yellow organic pigment ("Neo yellow MGR"), 30 parts of an acrylic ester-based resin emulsion (trade name: "Matsuminsol MR-96", product of Matsui Shikiso Chemical Co., Ltd.), 54 parts of an O/W emulsion (trade name: "Extender OS", an O/W emulsion manufactured by Matsui Shikiso Chemical Co., Ltd. and composed of water, mineral turpentine and a nonionic surface active agent) and 10 parts of water was filled into a tubular body of a pen to produce a tubular writing implement. Using this implement, characters were drawn on a T-shirt, jeans, sneakers and the like to a dry film thickness of 100 to 500 μm, followed by air-drying for about 3 hours. When these characters were exposed to light at an atmospheric temperature of about 25° C., the color of the characters changed from orange to brown. When the exposure of the characters to light was terminated, the characters turned orange again. When the atmospheric temperature was elevated to about 30° C. or higher without exposure of the characters to light, the characters turned yellow. When the yellow characters were further exposed to light, the color of the characters changed from yellow to green. On termination of exposure of the characters to light, the characters turned yellow again. Further, when the atmospheric temperature was descended to about 25° C., the characters returned to its original orange color. In this way, the color of the design drawn on the T-shirt and the like with this writing implement was variously changeable depending on light and temperature conditions, and the design looked much like a three-dimensional one.

TEST EXAMPLE 2

A 15 parts quantity of polyvinyl chloride concsol comprising 79 parts of polyvinyl chloride paste composed of 50% by weight of a polyvinyl chloride-based resin (trade name: "Geon 121", product of Nippon Zeon Co., Ltd.), 24% by weight of dibutyl phthalate, 24% by weight of a polyester-based plasticizer and 2% by weight of dibutyl stearate, 1 part of a nonionic surface active agent ("Solgen 30", product of Dai7ichi Kogyo Seiyaku Co., Ltd.), 9 parts of the photochromic material 2, 9 parts of the photochromic material 3, 0.2 part of a yellow organic pigment ("PV Fast Yellow H101G", product of Hoechst Co., Ltd.), 0.1 part of a red organic pigment ("Novaperm Red HF-3F", product of Hoechst Co., Ltd.) and 1.7 parts of titanium oxide ("$TiO_2$ JR 701", product of Teikoku Kako Co., Ltd.) was added to 85 parts of polyvinyl chloride paste having the same composition as above and the mixture was homogeneously stirred. The paste thus obtained was poured into a slush mold having a shape of a doll and heated at 180° C. for 2 minutes, whereby the paste gelled at its peripheral portions having a thickness of about 1 mm along the mold to form a solid film. The remaining liquid paste present at a distance of about 1 mm or more from the inner peripheral surface of the mold was removed by turning the mold upside down. The film was completely caused to gel by further heating at 200° C. for 2 minutes. After standing for cooling, the product was withdrawn from the mold to obtain a slush-molded doll. This doll assumed a flesh color within a room in which the sunlight did not stream. However, the doll turned tan at a window or outside the room where the doll was exposed to sunlight. This change of color was reversibly repeatable a countless number of times.

TEST EXAMPLE 3

To the surface of a miniature car which was made of zinc and treated with zinc phosphate was applied, by electrostatic deposition and to a dry film thickness of about 15 μm, a coating composition comprising 80 parts of an aminoalkyd resin solution ("Beckosol M-7610-50", product of Dainippon Ink And Chemicals, Incorporated.), 20 parts of titanium oxide ("$TiO_2$ JR 701"), 0.3 part of a nonionic surface active agent ("Homogenol L-100", product of Kao Co., Ltd.) and 20 parts of butyl cellosolve. The applied coating composition was air-dried for 5 minutes and heat-treated at 150° C. for 10 minutes to form a white covering layer. Subsequently, a coating composition comprising 80 parts of a thermosetting acrylic resin solution ("Dianal SE-1466", product of Mitsubishi Rayon Company Limited), 20 parts of the photochromic material 2, 50 parts of a petroleum naphtha ("Solvesso 100", product of Esso Standard Petroleum Co., Ltd.) and 0.3 part of the nonionic surface active agent (the same agent as above) was applied to the surface of the white covering layer to a dry film thickness of about 50 μm by electrostatic deposition. The applied coating composition was dried for 5 minutes and heat-treated at 150° C. for 10 minutes to form a photochromic layer. Furthermore, to the surface of the photochromic layer was applied, by electrostatic deposition and to a dry film thickness of about 60 μm, a transparent coating composition comprising 100 parts of the thermosetting acrylic resin solution (the same as above) and 100 parts of the petroleum naphtha (the same as above). The applied coating composition was air-dried for 5 minutes and heat-treated at 150° C. for 20 minutes to form an overcoating layer, whereby a photochromic miniature car was produced. When irradiated with light, the miniature car assumed a purple color. On termination of irradiation, the miniature car turned white. This change of color was reversibly repeatable a countless number of times.

TEST EXAMPLE 4

Into a padding bath equipped with a nozzle having a bore of 0.15 mm in diameter was placed a coating composition comprising 40 parts of an acrylic ester-based resin emulsion ("Yodosol LD1009", product of Kanebo Ltd.), 40 parts of a water-soluble polyurethane resin ("Hydran HW-111"), 20 parts of the photochromic material 1 and 20 parts of water. A monofilament of polyester having a fineness of 50 denier was immersed in the bath, withdrawn therefrom through the nozzle and dried in a drying oven at 150° C. for 10 seconds. Further, the monofilament was treated with a lubricant consisting of a silicone-based water repellant containing a chemical destaticizer to obtain a monofilament covered with a photochromic coating film and having a fineness of about 70 denier. When irradiated with light, the monofilament assumed a blue color. On termination of irradiation, the monofilament became colorless. This change was reversibly repeatable a countless number of times.

TEST EXAMPLE 5

A 20 parts quantity of the photochromic material 1, 30 parts of a low-molecular-weight polyethylene ("Sanwax 151P", product of Sanyo Chemical Industries, Ltd.) and 50 parts of a polyethylene resin ("Sumikathene G-801", product of Sumitomo Chemical Co., Ltd.) were mixed together with use of a V-type tumbler. The mixture obtained was placed into an extruder with heating, molten, kneaded and extruded from the mold. The extruded mixture was pelletized with use of an underwater pelletizer to form pellets, whereby a photochromic color masterbatch was prepared. A 15 parts quantity of the obtained color masterbatch, 0.2 part of a dry color ("Yellow PP020", product of Dainichiseika Colour & Chemicals Mfg. Co. Ltd.) and 85 parts of a molding polyethylene resin ("Sholex M113", product of Showa Yuka K.K.) were mixed together with use of a tumbling mixer and thereafter a bottle for drinks was produced with use of a blow molding machine under usual conditions. This bottle was yellow in a room unexposed to sunlight but turned green outside the room where the bottle was exposed to sunlight. This change of color was reversibly repeatable a countless number of times.

TEST EXAMPLE 6

A 0.2 part quantity of Compound 1 was fused in 4 parts of Compound a and the mixture was added, with stirring, to a vehicle comprising 93 parts of an acrylic ester-based resin emulsion ("Matsuminsol F23C", product of Matsui Shikiso Chemical Co., Ltd.), 2 parts of a 25% aqueous solution of ammonia, 4 parts of a melamine resin-based crosslinking agent ("Sumitex Resin M-3", product of Sumitomo Chemical Co., Ltd.) and 1 part of ammonium chloride, giving an ink. This ink was printed on 200 μm-thick cotton broad cloth using a polka-dotted screen (80 mesh) in an amount of about 80 $g/m^2$, and then rayon piles (1.5 denier×1.0 mm) were fixed thereon by electrostatic flocking to achieve a pile density (=100±5 $g/m^2$). After air-drying, the cloth was subjected to heat treatment at 150° C. for 3 minutes to produce a polka dots-printed cloth.

The polka dots on the cloth changes from white to blue when exposed to sunlight, and returned to its original white color upon termination of the exposure to sunlight. This change was repeatable a countless number of times. The light resistance was fourth or fifth grade.

EXAMPLE 32

A homogeneous hot solution comprising 5 parts of Compound 1, 105 parts of Compound a and 30 parts of an epoxy resin ("Epikote 828", product of Yuka Shell Epoxy K.K.) was poured into 500 parts of a 5% aqueous solution of hydroxyethyl cellulose maintained at 60° C. and dispersed with stirring to form oil droplets having a diameter of about 10 μm. Thereafter, 18 parts of a curing agent for curing epoxy resins ("Epicure U", product of Yuka Shell Epoxy K.K.) was added and the mixture was further stirred. The mixture was heated to 90° C. for reaction for 2 hours. The reaction mixture was cooled and the microcapsule particles obtained were separated by filtration, washed with water and dried, giving about 155 parts of coarse microencapsulated products. A 155 part portion of the coarse microencapsulated product obtained above was added to 500 parts of a 5% aqueous solution of gelatin heated to 60° C. and homogeneously dispersed therein with stirring. To the dispersion was added with stirring 50 parts of a 5% aqueous solution of carboxymethyl cellulose. The mixture was adjusted to a pH of 5.5 and cooled to 10° C. A 25 parts quantity of a 10% aqueous solution of formalin was added and the mixture obtained was allowed to stand for 5 minutes. While adding a 10% aqueous solution of caustic soda, the pH of the reaction system was adjusted to 10. The resulting dispersion of microcapsules having a particle size of 12 to 15 μm was separated by filtration and the microcapsules were washed with water and air-dried, followed by further drying at 80° C. for 2 hours, giving about 177 parts of microencapsulated products. This will be hereinafter referred to as "photochromic material 32".

TEST EXAMPLE 7

An ink was printed to a dry film thickness of about 60 μm on a 200 μm-thick releasable polyester film (600×400 mm) treated with a silicone resin using a screen (120 mesh) having carved thereon alphabetical characters, the ink being one prepared by adding 20 parts of the photochromic material 32 and 1 part of a fluorescent pigment ("Glow Yellow MF2G", product of Matsui Shikiso Chemical Co., Ltd.) to a vinyl chloride paste resin comprising 64 parts of a polyvinyl chloride resin ("Geon 121", product of Nippon Zeon Co., Ltd.), 32 parts of diisononyl phthalate, 3 parts of a Ba-Zn stabilizer and 1 part of dibutyltin laurate. The printed film was subjected to heat treatment at 130° C. for 1 minute to form a photochromic layer. Subsequently, using a screen (120 mesh) having carved thereon alphabetical characters 1 mm larger in contour than the above characters, an ink comprising 100 parts of the foregoing polyvinyl chloride paste resin and 15 parts of titanium oxide ("$TiO_2$ JR701") was printed on the design of the alphabetical characters to a dry film thickness of about 30 μm to form a covering layer. Before the covering layer was dried, a polyester resin powder of the hot-melt type ("Vyron GM900", product of Toyobo Co., Ltd.) was scattered on the entire face of the sheet to a thickness of about 80 μm on dry basis. The superfluous powder deposited on the portions other than the covering layer was eliminated and the layer was then heat-treated at 150° C. for 3 minutes using hot air to give a printed transfer sheet.

This sheet was brought into contact with the polyurethane side of laminated cloth of navy-blue polyurethane leather/rayon and heat transfer was conducted under conditions of 160° C., 10 sec and 100 $g/cm^2$ and the base material was peeled off. In this way, the design of the alphabetical characters transferred to the urethane leather cloth was yellow in a place unexposed to light but turned green when exposed to light. This change of color was reversibly repeatable a countless number of times. Further, the design of alphabetical characters was outstanding in luster and the characters had very sharp contour. The light resistance was sixth or seventh grade.

We claim:

1. A photochromic material characterized in that a composition having an organic photochromic compound dissolved or uniformly dispersed in a hindered amine compound is microencapsulated.

2. A photochromic material according to claim 1 wherein the hindered amine compound is used in an amount of at least 5 parts by weight per part by weight of the organic photochromic compound.

3. A photochromic material according to claim 1 wherein the organic photochromic compound is a spirooxazine compound.

4. A photochromic material according to claim 1 wherein the organic photochromic compound is a spriropyran compound.

5. A photochromic material according to claim 1 wherein the organic photochromic compound is a pyran compound.

* * * * *